US005163710A

United States Patent [19]

Chirtel et al.

[11] Patent Number: 5,163,710

[45] Date of Patent: Nov. 17, 1992

[54] ROLLER SKATING POLE

[76] Inventors: Stuart J. Chirtel, 2838 Lester Lee Ct., Arlington, Va. 22042; Imants Brolis, 2007 N. Edison St., Arlington, Va. 22207

[21] Appl. No.: 783,760

[22] Filed: Oct. 28, 1991

[51] Int. Cl.[5] ..... A63C 3/00

[52] U.S. Cl. ..... 280/809; 280/11.19; 135/78; 403/299

[58] Field of Search ..... 280/11.19, 11.22, 11.23, 280/819, 823, 826, 809; 135/77, 82, 86, 78; 403/299, 343

[56] References Cited

U.S. PATENT DOCUMENTS

| | | | |
|---|---|---|---|
| D. 262,646 | 1/1982 | Mace | 280/819 X |
| 1,349,639 | 8/1920 | Taylor et al. | 135/82 X |
| 1,817,829 | 8/1931 | Lanning | 135/82 |
| 2,253,012 | 8/1941 | Benner et al. | 280/11.22 |
| 3,355,185 | 11/1967 | Carter | 280/11.23 |
| 3,767,220 | 10/1973 | Peterson | 280/11.23 X |
| 3,894,807 | 7/1975 | Betz, III | 403/299 X |
| 4,003,668 | 1/1977 | Kelly, III et al. | 403/299 X |
| 4,003,669 | 1/1977 | Fenske et al. | 403/343 X |
| 4,424,987 | 1/1984 | Ryder | 280/823 |
| 4,596,405 | 6/1986 | Jones | 280/823 |
| 4,958,650 | 9/1990 | Dale | 280/819 X |
| 5,048,851 | 9/1991 | Alarcon | 280/11.23 X |

FOREIGN PATENT DOCUMENTS

| | | | |
|---|---|---|---|
| 153861 | 7/1938 | Fed. Rep. of Germany | 280/819 |
| 2602634 | 7/1977 | Fed. Rep. of Germany | 280/819 |
| 2722762 | 11/1978 | Fed. Rep. of Germany | 280/823 |
| 65860 | 3/1943 | Finland | 280/819 |

*Primary Examiner*—Charles A. Marmor
*Assistant Examiner*—Brian L. Johnson
*Attorney, Agent, or Firm*—Lawrence I. Field

[57] ABSTRACT

A pole useful when skating on in line roller skates. A rigid pole with a specially designed tip which is useful when skating on in-line roller skates and which assists a skater to control his speed of forward motion and may be used as a training aid for beginners learning to skate on in-line roller skates.

5 Claims, 2 Drawing Sheets

ROLLER SKATING POLE

FIELD OF THE INVENTION

This invention relates to a pole useful when skating on in line roller skates. More particularly it relates to a device which may be used either as a training aid, or as a means for propulsion, or to provide speed control or as a braking means for a person on in line roller skates.

A principal object of the invention is to provide a device which permits a skater on in line roller skates to control his speed of forward motion.

Another object of the invention is to provide a training aid for beginners learning to skate on in line roller skates.

Another object of the invention is to provide a device which may be used to propel a person forward when skating on in line roller skates.

These and other objects will be apparent or will be pointed out in the description that follows in which:

DESCRIPTION OF THE PREFERRED EMBODIMENTS

Figure 2:
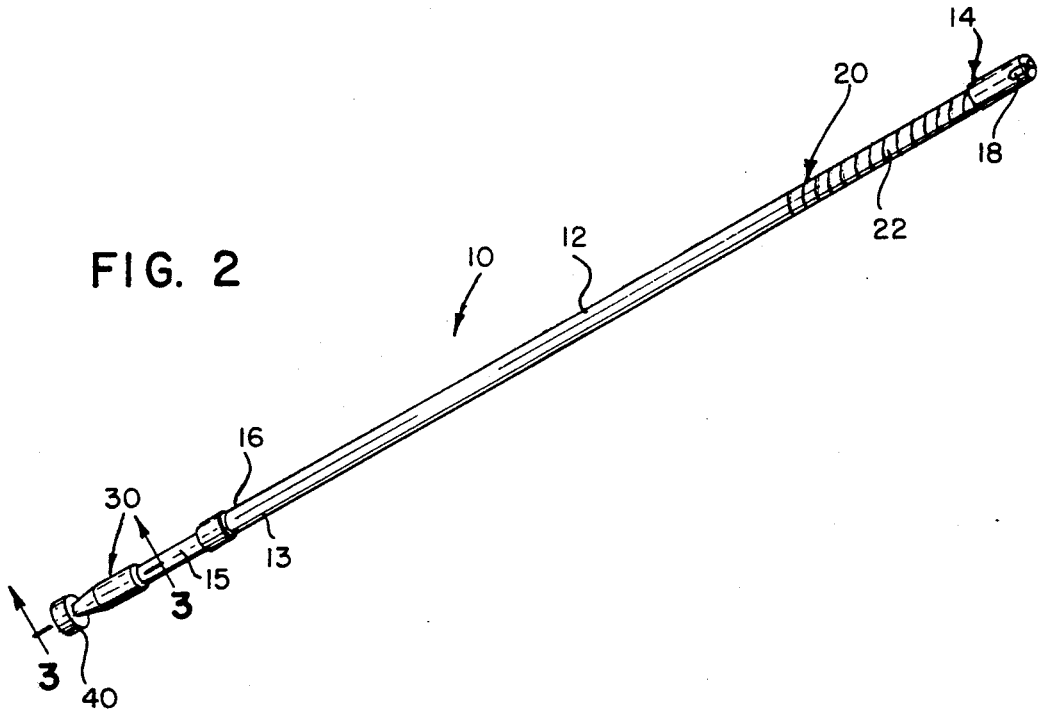
FIG. 2 is a view in perspective of the device.
Figure 3:
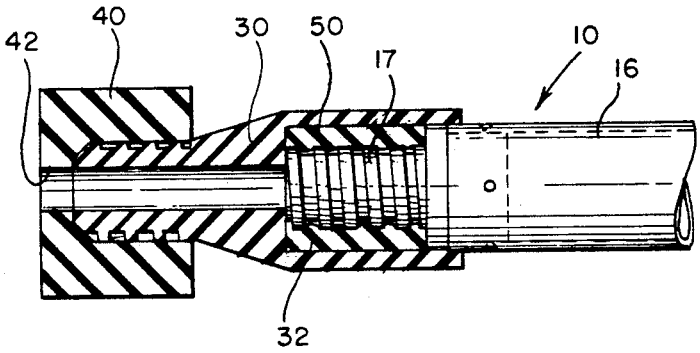
FIG. 3 is a view partly in section of the bottom portion of the device of FIG. 2 taken on plane 3—3.
Figure 4:
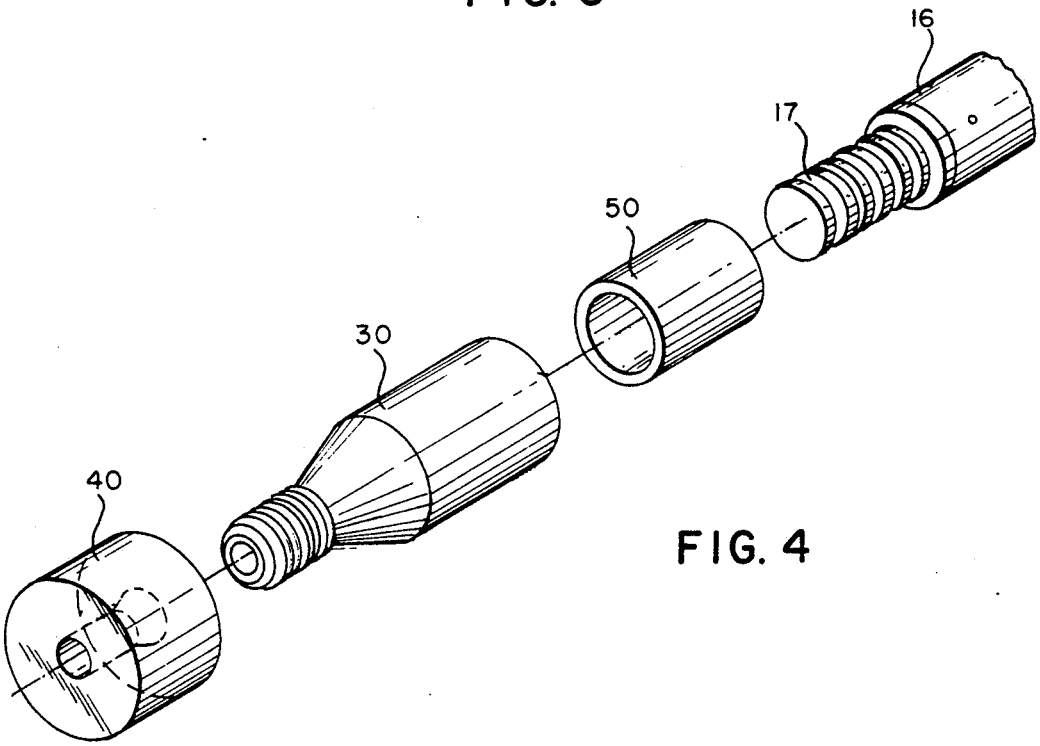
FIG. 4 is an exploded view of the lower end of the device of FIG. 2 prior to assembly.

As seen in FIG. 2, the device 10 which constitutes the present invention comprises at least the following: a rigid pole 12 having an upper end 14 and a lower end 16 terminating in a threaded tip 17. At the upper end 14 means are provided for receiving a strap 18 which is an optional means to assist a user to hold pole 12. The preferred grip 20 is a gripping tape 22 which is tightly wound around the upper end 14 of pole 12 and which may be secured to the pole by any suitable adhesive.

The poles can be made of metal, wood, fiberglass, or any composite material. The pole length can be fixed or adjustable e.g. by making the pole of a plurality of pieces 13, 15 which telescope into one another. The diameter of the pole can range from ½" to 1" and should be sufficient to make the pole rigid. The grip can be a preformed 'pistol grip', ski pole grip, bicycle grip or the grip may be created by wrapping the top section of the pole with grip tape, as shown in FIG. 2.

At the lower end of pole 12 is an adapter 30 which screws onto a threaded section 17 at the lower end of the pole. The adapter 30 serves as a coupling means to couple pole 12 to a cylindrical tip 40 made of a relatively hard rubber. The tip 40 may be assembled to the adapter 30 by forcing the adapter into a bevelled hole 42 bored into tip 40. The diameter of hole 42 is about 30% smaller than the diameter of the threaded portion of the adapter 30 which is forced into the bevelled hole, whereby a very secure pressure fit results from forcing the adapter into hole 42. Except that it is made of rubber, the adapter may be designed as shown in U.S. Pat. No. 4,003,668. A thin flexible sleeve 50 is inserted in the end portion 32 of the adapter and this assembly is threaded onto the lower end of the pole.

Figure 1:
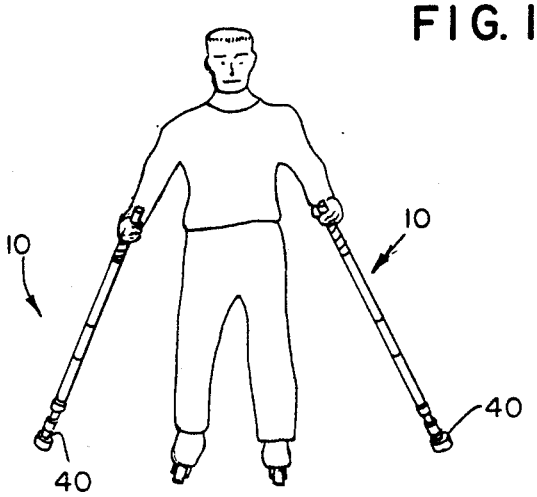
FIG. 1 is a view in perspective showing the device of the invention in use.

Rigid pole 12 may be used by a skater to propel the skate forward in much the same way that ski poles are used. As shown in FIG. 1 the skater has a pole in each hand and as he leans forward he brings tip 40 into contact with the ground and pushes as the poles pivot on tip 40. This propels the skater forward. He can also propel himself backwards if he so desires.

When the skater wishes to slow down or stop he grips the poles at their upper ends and inclines them rearwardly and downwardly permitting tip 40 to drag on the ground. Depending on the pressure the user brings to bear on tip 40 he can either slow down or stop completely.

The tip 40 may either be joined to the adapter 30 by forcing the adapter into a hole 42 bored into tip 40, or as is preferred a thin flexible sleeve 50 is placed on the threaded portion of the adapter and this assembly is forced into the bore of hole 42.

Pole 12 may be either of a fixed length or it may be adjustable in length, e.g. it may consist of telescoping sections so that it can be extended to accommodate to the size of the ultimate user.

The tip 40 is preferably made of a synthetic or natural rubber and is required to be resilient enough to absorb the shock of being brought to bear on the ground when the user wants to stop his forward advance, but not too hard which would interfere with its action as a brake. It must be able to wear well when it moves along the ground. Of course tip 40, with or without a sleeve is readily removable from the threaded portion of adapter 30 so that it can be replaced when it wears out.

In one pole constructed according to this invention the tip 40 has a length between 1 and 2 inches (e.g. 1.2 inches), a diameter of between 1 and 2 inches (e.g. 1.5 inches) and a bore of about ⅜ inches. Pole 12, when collapsed is about 44 inches long.

A pair of poles designed in the manner described above can be used for the following purposes:

1) With the poles, novice skaters are provided with support to launch their first tentative steps. As they skate, their sense of balance is reinforced. The poles help reestablish their center of gravity whenever balance might be lost. This is especially useful for the marginal athlete.
2) With the poles any skater will experience a upper-body workout thus increasing the exercise benefits of skating.
3) With the poles, an intermediate skater is able to use in line skates on bike trails and residential streets. The poles provide stability in challenging circumstances such as going up and down inclines. On upward inclines the poles are used, to provide added thrust to help in reaching the top. On downward inclines with the poles dragged behind and leveraged against the back of the arm or shoulder, the poles provide additional braking force to control the speed of descent.
4) For the downhill and cross country skier in the off season, being able to skate with the poles allows the skiers to continue exercising and strengthening muscles they would normally use in their respective sports. They also are able to simulate skiing and work on their form.

Having now described a preferred embodiment of the invention it is not intended that it be limited except as may be required by the appended claims.

We claim:

1. A device for use with in line roller skates comprising: a rigid pole having and upper end and a lower end; a threaded section on the lower end of said pole an adapter serving as a coupling means to couple said pole to a tip, said adapter having an upper end into which the threaded section on said pole may be inserted and an externally threaded lower end;

a thin flexible sleeve adapted to be inserted into the upper end portion of said adapter for threadedly receiving the threaded end of said rigid pole coupled to said adapter;

and a shock absorbing solid rubber tip having a bore into which said threaded lower end of said adapter may be inserted.

2. The device of claim 1 wherein the pole consists of a plurality of pieces which telescope into one another.

3. The device of claim 1 including in addition a strap secured adjacent the upper end of the pole.

4. The device of claim 1 in which the tip is approximately between 1 & 2" long, and between 1 and 2 inches in diameter and has a central bore of approximately $\frac{3}{8}$".

5. The device of claim 1 wherein a grip is formed by wrapping a tape around a portion of the pole adjacent the upper end of said pole.

* * * * *